US011098900B2

(12) United States Patent
Borror

(10) Patent No.: US 11,098,900 B2
(45) Date of Patent: Aug. 24, 2021

(54) FUEL INJECTORS AND METHODS OF MAKING FUEL INJECTORS

(71) Applicant: Delavan Inc, West Des Moines, IA (US)

(72) Inventor: Dustin Andrew Borror, Norwalk, IA (US)

(73) Assignee: Delavan Inc., West Des Moines, IA (US)

( * ) Notice: Subject to any disclaimer, the term of this patent is extended or adjusted under 35 U.S.C. 154(b) by 659 days.

(21) Appl. No.: 15/656,714

(22) Filed: Jul. 21, 2017

(65) Prior Publication Data

US 2019/0024900 A1 Jan. 24, 2019

(51) Int. Cl.

| | |
|---|---|
| ***F23R 3/28*** | (2006.01) |
| ***F23D 11/38*** | (2006.01) |
| ***F23R 3/34*** | (2006.01) |

(52) U.S. Cl.

CPC ..... *F23R 3/286* (2013.01); *F23D 11/38* (2013.01); *F23R 3/28* (2013.01); *F23R 3/283* (2013.01); *F23R 3/343* (2013.01); *F23R 2900/00017* (2013.01)

(58) Field of Classification Search

CPC .. F23R 3/28; F23R 3/283; F23R 3/286; F23R 3/34; F23R 3/343

See application file for complete search history.

(56) References Cited

U.S. PATENT DOCUMENTS

| | | | | |
|---|---|---|---|---|
| 6,381,964 | B1 * | 5/2002 | Pritchard, Jr. | F23R 3/14 60/746 |
| 6,389,815 | B1 * | 5/2002 | Hura | F23R 3/346 60/746 |
| 6,546,732 | B1 * | 4/2003 | Young | F23D 14/78 60/740 |
| 6,718,770 | B2 * | 4/2004 | Laing | F23D 11/36 239/548 |
| 6,865,889 | B2 * | 3/2005 | Mancini | F23R 3/286 60/737 |
| 9,464,808 | B2 * | 10/2016 | Paskevich | F23R 3/286 |
| 2008/0098737 | A1 | 5/2008 | Haggerty et al. | |
| 2009/0140073 | A1 | 6/2009 | Thomson et al. | |
| 2010/0064690 | A1 * | 3/2010 | Bailey | F23R 3/283 60/734 |
| 2010/0107653 | A1 | 5/2010 | Paskevich et al. | |

(Continued)

FOREIGN PATENT DOCUMENTS

EP 3012525 A1 4/2016

OTHER PUBLICATIONS

Extended European Search Report dated Nov. 14, 2018, issued during the prosecution of European Patent Application No. EP 18183899.6 (9 pages).

*Primary Examiner* — Craig Kim

(74) *Attorney, Agent, or Firm* — Locke Lord LLP; Scott D. Wofsy; Gabrielle L. Gelozin

(57) ABSTRACT

A fuel injector includes an outer body and an inner body. The outer body extends about an axis and has a radially inner surface and a retention groove defined in the inner surface of the outer body. The inner body is positioned within the outer body has an outer surface and a retention tab. The retention tab retains the inner body relative to the outer body by engagement of the retention tab within the retention groove. A is axially offset from the retention tab and fixes the inner body within the outer body.

18 Claims, 5 Drawing Sheets

(56) References Cited

U.S. PATENT DOCUMENTS

| | | | |
|---|---|---|---|
| 2015/0167984 | A1 | 6/2015 | Bellino et al. |
| 2016/0115926 | A1 | 4/2016 | Ryon et al. |
| 2016/0298848 | A1 | 10/2016 | Geary et al. |

* cited by examiner

Fig. 8
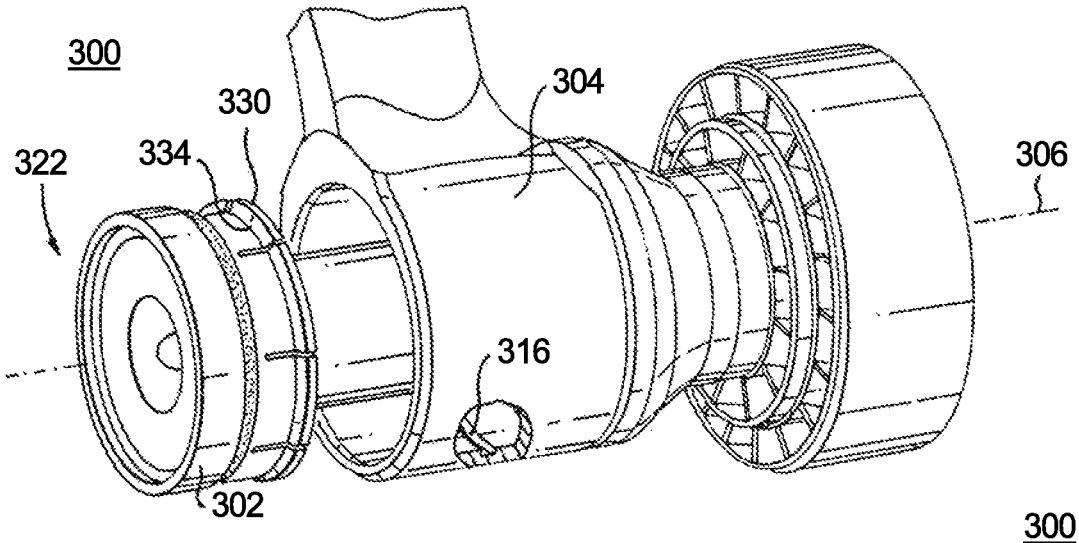
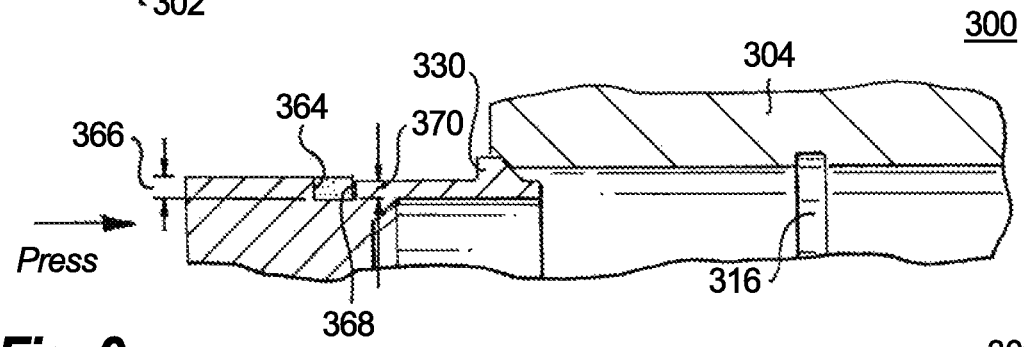
Fig. 9
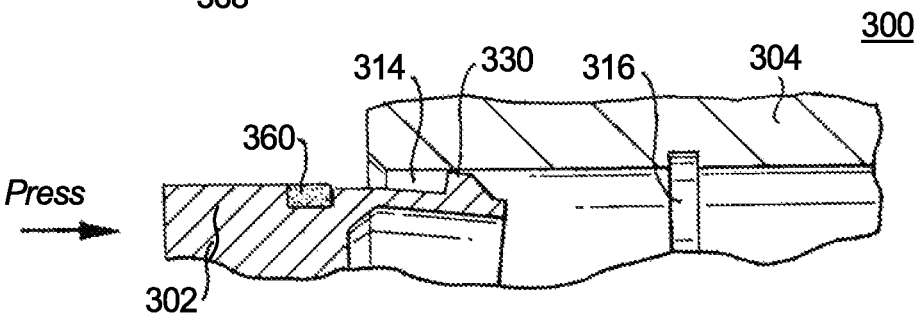
Fig. 10
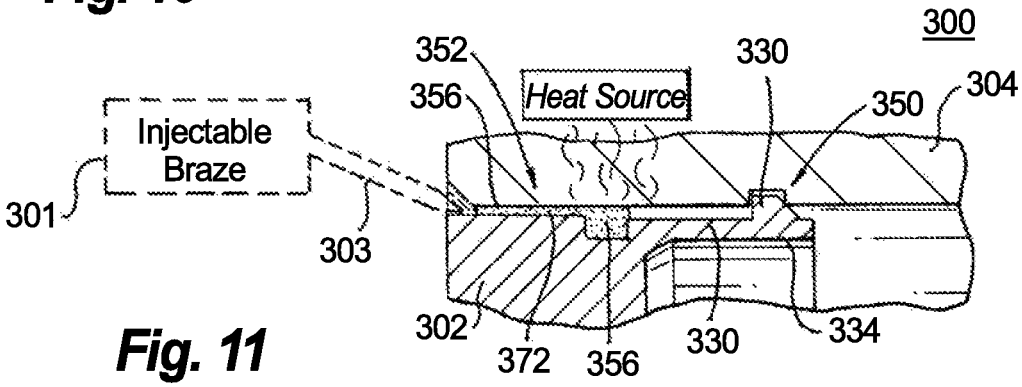
Fig. 11

Fig. 12
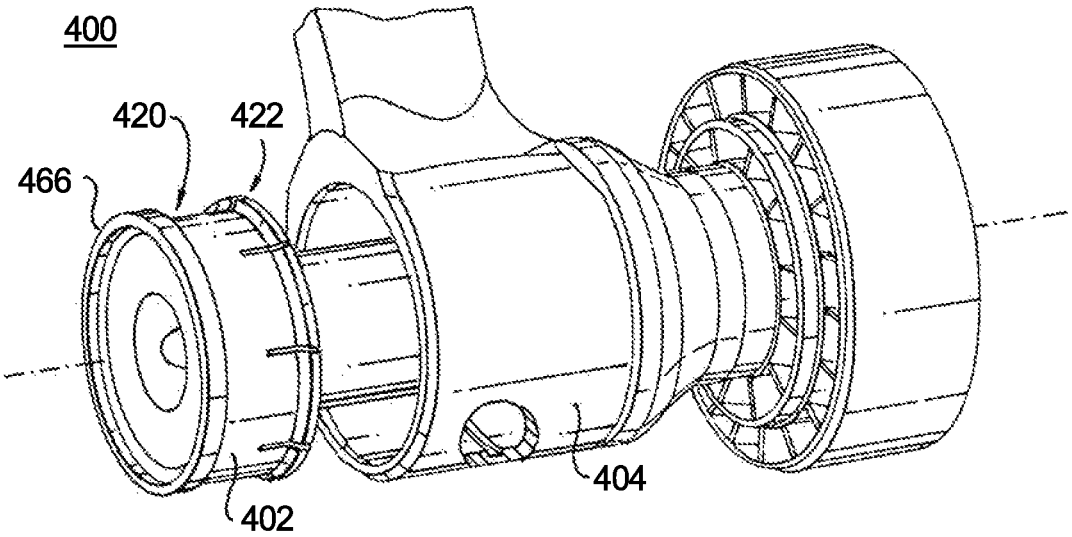
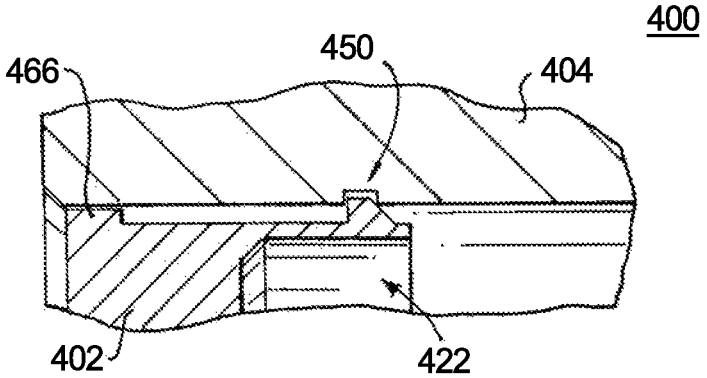
Fig. 13
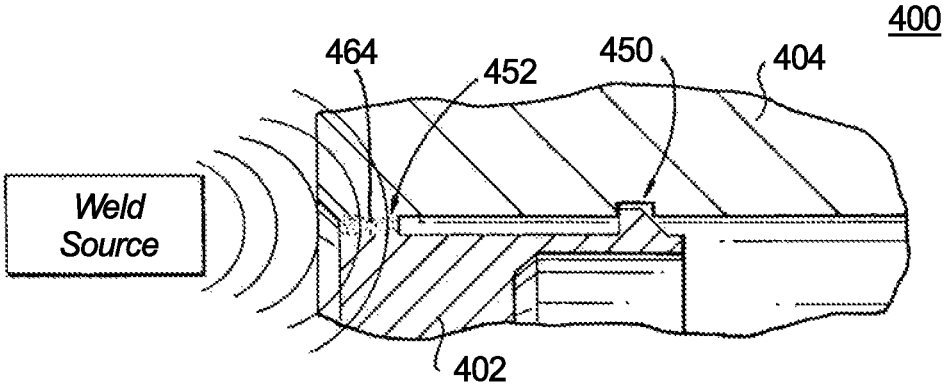
Fig. 14

FUEL INJECTORS AND METHODS OF MAKING FUEL INJECTORS

BACKGROUND OF THE INVENTION

1. Field of the Invention

The present disclosure relates to gas turbine engines, and more particularly to fuel injectors and methods of making fuel injectors for gas turbine engines.

2. Description of Related Art

Gas turbine engines, such as in aircraft, commonly include fuel injectors with passages for directing fuel into combustors under high temperature conditions. Because of the high temperature conditions, fuel injectors typically include heat shielding to prevent the fuel from coking within the passages, which can occur when the wetted wall temperatures of the passage walls exceed a particular temperature. Coke in fuel injector fuel passages can accumulate, potentially restricting fuel flow to the nozzle and reduce the service life of the fuel injector.

One approach to insulating fuel injectors from heat is the use of stagnant air gaps between external walls, which are exposed to high temperature, and internal walls, which are in thermal contact with the relatively cool fuel. Establishing such gaps requires fastening the walls together such that the assembly can accommodate differing thermal expansion between the walls while holding the nozzle components together. Fastening is commonly accomplished by temporarily fastening the walls together with a fixture in a first operation, permanently fastening the walls together in a second operation, and thereafter removing the fixture in a third operation. The fixture, which can be a ball tack or wire tie down holds the walls in place while being permanently fastened to one another.

Such conventional methods and systems have generally been considered satisfactory for their intended purpose. However, there is still a need in the art for improved fuel injector and methods of making fuel injectors. The present disclosure provides a solution for this need.

SUMMARY OF THE INVENTION

A fuel injector includes an outer body and an inner body. The outer body extends about an axis and has a radially inner surface and a retention groove defined in the inner surface of the outer body. The inner body is positioned within the outer body has an outer surface and a retention tab. The retention tab retains the inner body relative to the outer body by engagement of the retention tab within the retention groove. A joint is axially offset from the retention tab and fixes the inner body within the outer body.

In certain embodiments, inner body can define an axial slot. The axial slot can bound the retention tab. The retention tab can have a resilient member. The retention tab can have a barb. The barb can extend radially from the resilient member. The resilient member can extend axially between the barb and a first end of the inner body. The resilient member can extend axially between the barb and a second end of the inner body. The outer body can have a first end, an opposite second end, and a ramp. The ramp can be arranged on the first end of the outer body. The inner body can be retained relative to the outer body between the ramp and the second end of the outer body.

In accordance with certain embodiment, the joint can be a brazed joint. The joint can include a braze structure. The braze structure can be disposed between the outer surface of the inner body and the inner surface of the outer body. The inner body can have a groove in the outer surface of the inner body. The groove can be bounded by a first shoulder and a second shoulder. The first shoulder can be on a side of the groove opposite the retention tab. The first shoulder can have a radial height greater than a radial height of the second shoulder. The braze structure can overlay, at least in part, the groove. Prior to forming the joint, a braze ring can be seated in the groove.

It is contemplated that the inner body can have a braze target. The braze target can be on the outer surface of the inner body. The braze target can be axially offset from the retention tab. The braze structure can at least partially overlap the braze target. The inner body can have a braze stop. The braze stop can be arranged in the outer surface of the inner body. The braze stop can be arranged axially between the retention tab and the braze target. It is also contemplated the joint can be a welded joint. The joint can include a weld structure. The weld structure can be disposed between the interior surface of the outer body and exterior surface of the inner body.

It is further contemplated that, in accordance with certain embodiments, the inner body can include a heat shield. The outer body can include a prefilmer. One or more intermediate bodies can be arranged radially between the inner body and the outer body. The outer body, intermediate body, inner body can include a heat shield, a swirler, and a prefilmer. Each of the inner body, intermediate body, and outer body can be retained within the fuel injector by respective engagement joints and welded or brazed joints. The engagement joints can include the retention tab. The brazed or welded joints can include a braze structure or a weld structure.

A fuel injector includes an outer body as described above. The inner body includes a heat shield with an outer surface and a retention tab is positioned within the outer body. The retention tab of the heat shield retains the heat shield within the outer body. A joint is axially offset from the retention and retains the inner body to the outer body. The joint includes a braze structure that is disposed between the outer surface of the heat shield and the inner surface of the outer body.

A method of making a fuel injector includes inserting an inner body within an outer body. The inner body is pressed against the outer body such that an inner body retention tab seats within a retention groove defined within the inner surface of the outer body. A joint axially offset from the retention tab along the inner body is formed by heating the bodies, redundantly retaining the inner body within the outer body. In certain embodiments, the method can include seating a braze ring on the inner body at a location axially offset from the retention tab along the inner body prior to positioning the inner body within the outer body. In accordance with certain embodiments heating the inner body and the outer body includes interfusing material from the outer body with the inner body in a welding operation.

It is also contemplated that, in accordance with certain embodiments, the method can include inserting one or more intermediate bodies within an outer body. The intermediate body can be pressed within the outer body such that a retention tab of the intermediate body seats within a second retention groove defined within the fuel injector. Heating can include heating the inner body, intermediate body, and outer body to coincidently form a joint axially offset from the intermediate body retention tab along the intermediate body while the joint between the inner body and outer body is formed.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein:

FIG. 8 is an exploded view of a fuel injector according to a third embodiment, showing an inner body with retention tabs arranged on the second end of the inner body;

FIGS. 9 and 10 are cross-sectional views of fuel injector of FIG. 8, showing the inner body being positioned and pressed within the outer body;

FIG. 11 is a cross-sectional views of the fuel injector of FIG. 8, showing a brazed joint being formed between the second end of the inner body and outer body while the retention tabs retain the inner body relative to the outer body;

FIG. 12 is an exploded view of a fuel injector according to a fourth embodiment, showing an inner body with retention tabs arranged on the second end of the inner body and a weld target arranged on the first end of the inner body;

FIG. 13 is a cross-sectional view of fuel injector of FIG. 12, showing the inner body positioned and retained within the outer body by engagement of the retention tabs in the retention groove;

FIG. 14 is a cross-sectional views of the fuel injector of FIG. 12, showing a welded joint being formed between the first end of the inner body and the outer body while the retention tabs retain the inner body relative to the outer body.

DETAILED DESCRIPTION OF THE PREFERRED EMBODIMENTS

Figure 1:
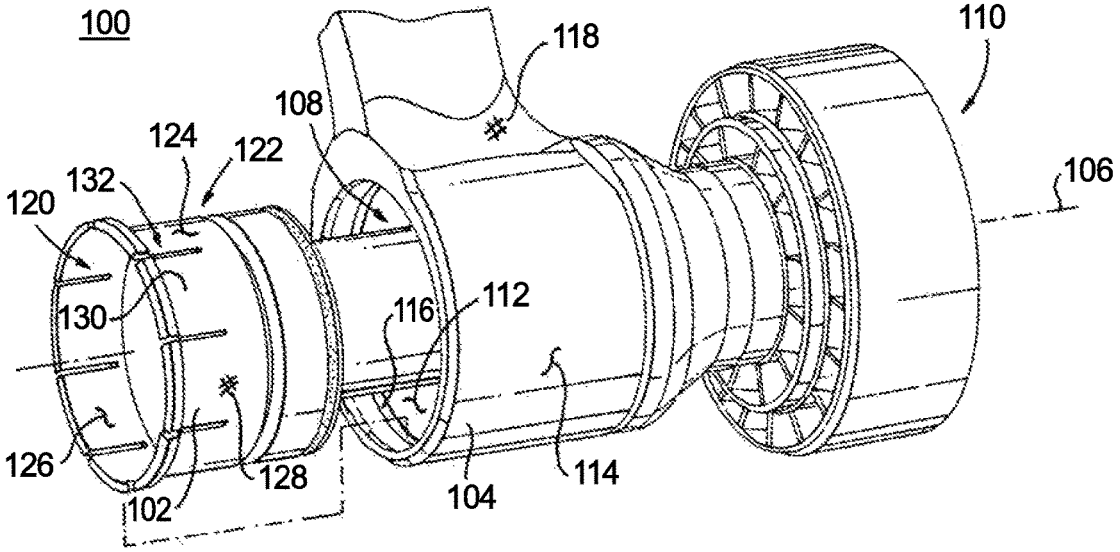
FIG. 1 is an exploded view of a fuel injector constructed in accordance with the present disclosure, showing an outer body with a retention groove and an inner body with retention tabs arranged on a first end of the inner body.

Reference will now be made to the drawings wherein like reference numerals identify similar structural features or aspects of the subject disclosure. For purposes of explanation and illustration, and not limitation, a partial view of an exemplary embodiment of a fuel injector in accordance with the disclosure is shown in FIG. 1 and is designated generally by reference character 100. Other embodiments of fuel injectors and methods of making fuel injectors in accordance with the present disclosure, or aspects thereof, are provided in FIGS. 2-15 as will be described. The systems and methods described herein can be used fuel injectors for gas turbine engines, where the tolerances and concentricity required by injectors can pose significant challenges to the manufacture of injectors for aircraft main engines and auxiliary power units, however the present disclosure is not limited to fuel injector aircraft gas turbine engines.

Referring to FIG. 1, fuel injector 100 is shown. Fuel injector 100 includes an inner body 102 and an outer body 104. As shown in the illustrated exemplary embodiment, outer body 104 is a fuel injector housing and inner body 102 is a fuel injector heat shield. This is for illustration purposes only and is non-limiting. As will also be appreciated by those of skill in the art in view of the present disclosure, inner body 102 and outer body 104 can be any cylindrical element of fuel injector 100. For example, either (or both) of inner body 102 and outer body 104 can be a prefilmer, swirler, heat shield, or inlet fitting for a fuel injector.

Outer body 104 defines an assembly axis 106, extends about assembly axis 106, and has an inlet end 108 and an outlet end 110 arranged on opposite ends of an annular body coupling inlet end 108 with outlet end 110. Outer body 104 also has a radially outer surface 114 and an opposed radially inner surface 112 separated by a thickness of outer body 104. A retention grove 116 is defined in inner surface 112. It is contemplated that outer body 104 be formed from a metallic material 118, such as a stainless steel alloy. In the illustrated exemplary embodiment retention groove 116 extends continuously about assembly axis 106.

Inner body 102 is configured to be retained within outer body 104 prior to forming a joint 152 (shown in FIG. 5) fixing inner body 102 within outer body 104. Inner body 102 has a first end 120 and an opposed second end 122 that are coupled to one another by an annular body. Inner body 102 also has a radially outer surface 124 and an opposed radially inner surface 126 separated by a thickness of inner body 102. It is contemplated that the outer body be formed from a metallic material 128, such as a stainless steel alloy, which may or may not be identical to metallic material 118 of outer body 104. One or more retention tab 130 is arranged about inner body 102 and extends therefrom along inlet end 120. Each of the one or more retention tabs 130 are bounded by axial slots 132 that extend partially along an axial length of inner body 102. In the illustrated exemplary embodiment inner body 102 has eight (8) retention tabs 130 separated by eight (8) axial slots 132. This is for illustration purposes only and is non-limiting. Those of skill in the art will appreciate in view of the present disclosure that fuel injector assemblies described herein can have inner bodies with fewer than eight retention tabs or more than eight retention tabs, as suitable for an intended application.

Figure 2:
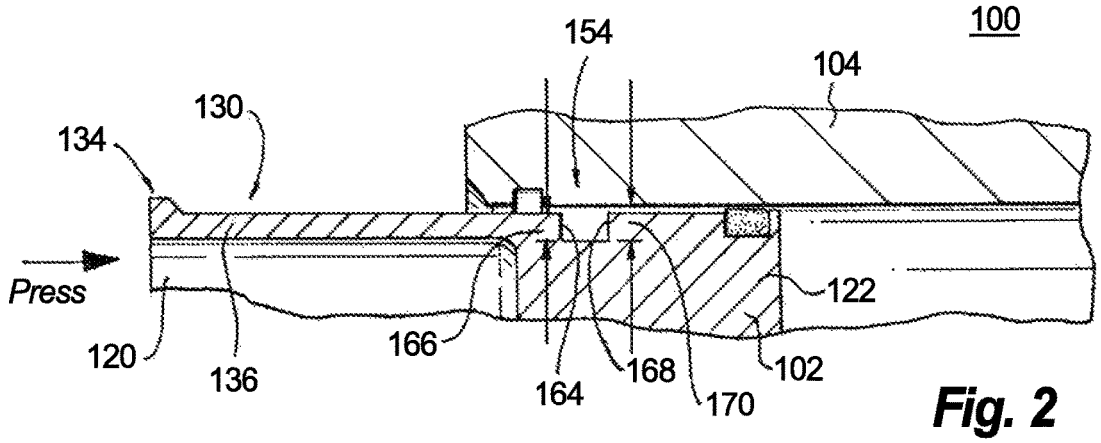
FIGS. 2-4 are cross-sectional views of the fuel injector of FIG. 1, showing the inner body being positioned within the inner body, pressed therein, and retained therein by engagement of the retention tabs in the retention groove, respectively.

With reference to FIGS. 2-5, positioning, retention, and fixation of inner body 102 within outer body 104 are shown. As shown in FIG. 2, inner body 102 is registered to outer body 104 along assembly axis 106 (shown in FIG. 1) and pressed into outer body 104. Registration can include centering inner body 102 within outer body 104 such inner body 102 is coaxial with outer body 104 along assembly axis 106. Registration can include clocking inner body 102 relative to outlet body 104 about assembly axis 106. Registration can include both centering and clocking inner body 102 relative to outer body 104 along and about assembly axis 106.

Pressing inner body 102 within outer body 104 includes applying a pressing force against inner body 102. The pressing force is directed against inner body 102, along assembly axis 106 (shown in FIG. 1), and towards outlet end 110 of outer body 104. It is contemplated that inner body 102 have a radially outer dimension that exceeds a radial inner dimension of outer body 104. Accordingly, the pressing force can be applied such that an interference fit exists between inner body 102 and outer body 104. It is contemplated that the pressing force can be applied by a manual press. For example, an arbor press can be used to position inner body 102.

First end 120 of inner body 102 includes retention tab 130. Retention tab 130 includes a resilient member 136 and a barb 134. In the illustrated embodiment resilient member 136 extends from first end 120 of inner body 102 and towards second end 122 of inner body 102. Barb 134 extends radially outward from resilient member 136. Resilient member 136 is cantilevered and flexible. Being flexible, resilient member deflects as inner body 102 is positioned within outer body 104, barb 134 moving radially inward from a nominal position (shown in FIG. 2) to a deflected position (shown in FIG. 3). Having resiliency, resilient member 136 is arranged to urge barb 134 into a seated position (shown in FIG. 4) corresponding to axial of inner body 102 within outer body 104, wherein barb 134 seats in groove 116 (shown in FIG. 1).

Figure 3:
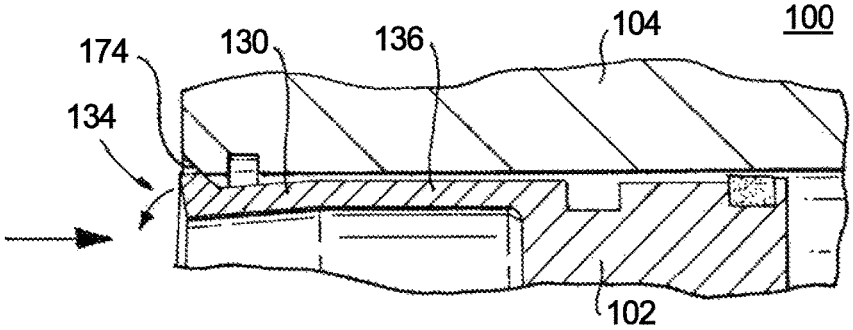

Referring to FIG. 3, as inner body 102 is pressed into outer body 104 barb 134 comes into sliding contact with inner surface 112 of outer body 104. Sliding contact of barb 134 with inner surface 112 of outer body 104 deflects resilient member 136, moving 134 radially inward relative to outer body 104 to the deflected position. Barb 134 retain the deflected position until inner body 102 is positioned within outer body 104 such that retention groove 116 radially overlaps 134 (shown in FIG. 4), at which point resilient member drives barb 134 into retention groove 116, retention tab 130 thereby engaging retention groove 116. Engagement of retention tab 130 with retention groove 116 forms an engagement joint 150 (shown in FIG. 4) between inner body 102 and outer body 104, engagement joint 150 retaining position of inner body 102 within outer body 104. In certain embodiments engagement of retention tab 130 is accompanied by an audible click, which signals to an assembler operating the press that inner body 102 is correctly positioned within outer body 104 and error-proofing position of inner body 102 within outer body 104.

Deflection can be assisted by a ramp 174. Ramp 174 is arranged axially between first end 108 and second end 110 of outer body 104. As inner body 102 is positioned within outer body 104 ramp 174 progressively deflects retention tab 130 according to the axial position of inner body 102 relative to outer body 104, limiting the pressing force necessary to move barb 134 from the nominal position (shown in FIG. 2) and the deflected position (shown in FIG. 3). It is contemplated that, once positioned, that inner body 102 be axially between ramp 174 and second end 110 of outer body 104, as shown in FIG. 4.

Figure 4:
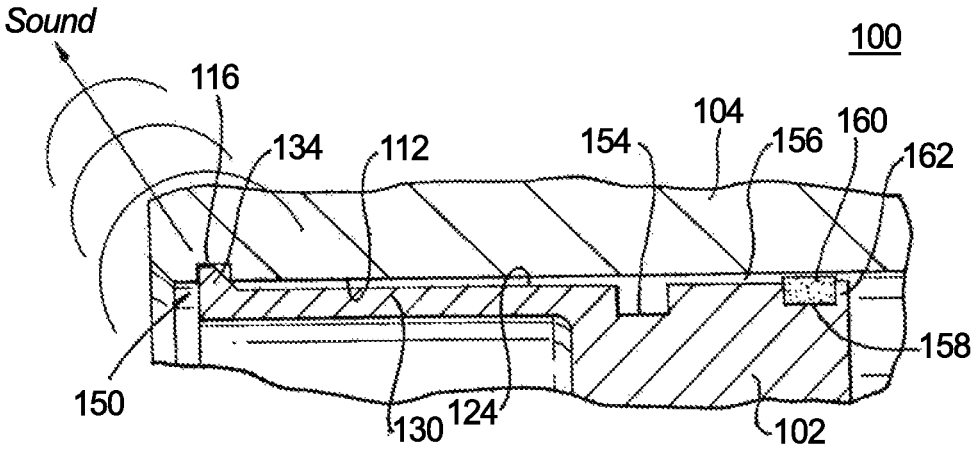

With reference to FIG. 4, structures associated with formation of a brazed joint 152 (shown in FIG. 5) are shown. Outer surface 124 of inner body 102 has an optional braze stop 154, a braze target 156, and a groove 158. Braze stop 154 is arranged axially between retention tab 130 and braze target 156. Braze target 156 is arranged axially between braze stop 154 and groove 158. A braze ring 160 is seated within groove 158, extends circumferentially about inner body 102 within groove 158, and is in intimate mechanical contact with outer body inner surface 112. Braze ring 160 includes a metallic material 162, such as a gold-nickel alloy, suitable for forming brazed joint 152.

Figure 5:
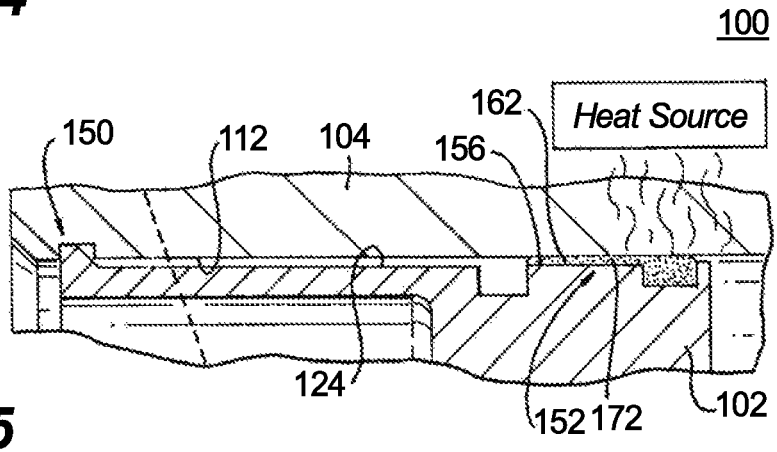
FIG. 5 is a cross-sectional views of the fuel injector of FIG. 1, showing a brazed joint being formed between a second end of the inner body and the outer body while the retention tabs retain the inner body relative to the outer body.

With reference to FIG. 5, application of heat to braze ring 160 (shown in FIG. 4) causes metallic material 162 to melt. As metallic material 162 melts, molten metallic material 162 flows axially along braze target 156 (shown in FIG. 4) from groove 158 via capillary action. The flow of molten metallic material 162 ceases at about the location of braze stop 154. Once cooled metallic material 162 forms a braze structure 172. Braze structure 172 at least partially overlaps braze target 156 and groove 158, and is disposed between outer surface 124 of inner body 102 and inner surface 112 of outer body 104.

In the illustrated exemplary embodiment flow of metallic material 162 is confined by braze stop 154. As shown in FIG. 2, braze stop 154 is bounded axially by a first shoulder 164 with a first radial height 166 and a second shoulder 168 with a second radial height 170. The first height can be substantially the same as the second owing to the axial separation of first shoulder and second shoulder, the radial depth of braze stop 154 being sufficient to prevent capillary action from conveying metallic material 162 across braze stop 154. Formation of brazed joint 152 can be, for example, as described in U.S. patent application Ser. No. 11/998,584, filed Nov. 30, 2007, the contents of which are incorporated herein by reference in their entirety.

In certain embodiments, engagement joint 150 can be removed subsequent to the formation of brazed joint 152. For example, a material removal operation (shown with a dashed line) can be used to remove engagement joint 150. The material removal can be done without disturbing the position of inner body 102 within outer body 104 due to brazed joint 152, which is axially spaced apart from engagement joint 150. Material removal can reduce the weight of fuel injector 100.

Figure 6:
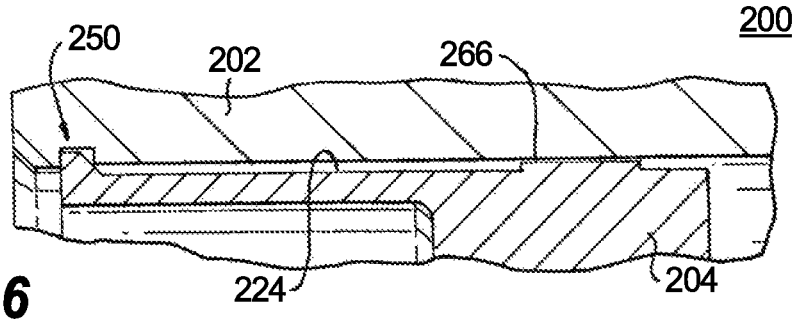
FIG. 6 is a cross-sectional view a fuel injector according to a second embodiment, showing retention tabs retaining an inner body relative to an outer body subsequent to the inner body being positioned and pressed within the outer body.
Figure 7:
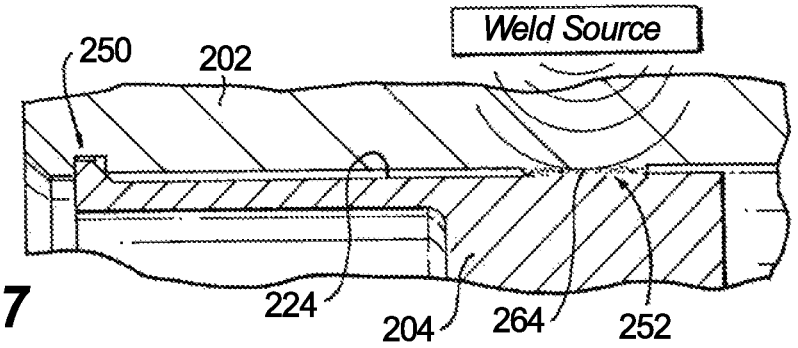
FIG. 7 is a cross-sectional view of the fuel injector of FIG. 6, showing a welded joint being formed between the second end of the inner body and the outer body while the retention tabs retain the inner body relative to the outer body.

Referring to FIGS. 6 and 7, a fuel injector 200 according to a second embodiment is shown. Fuel injector 200 is similar to fuel injector 100 (shown in FIG. 1), and additionally includes a welded joint 252 (shown in FIG. 7) with a weld structure 264 (shown in FIG. 7).

As shown in FIG. 6, an inner body 202 includes a weld target 266. Weld target 266 is disposed on outer surface 224 of inner body 202 and may include a prepared surface portion, such as by etching or polishing. Weld target 266 projects radially from outer surface 224 to preferentially receive weld energy for forming weld structure 264.

As shown in FIG. 7, upon application of heat from a weld source, weld structure 264 is formed between inner body 202 and outer body 204. Weld structure 264, which may comprise native material from either or both of inner body 202 and outer body 204, fuses inner body 202 within outer body 204 with a welded joint 252. Welded joint 252 thereafter cooperates with first joint 250 to retain inner body 202 within outer body 204.

With reference to FIGS. 8-11, a fuel injector 300 according to a third embodiment is shown. Fuel injector 300 is similar to fuel injector 100 (shown in FIG. 1) and additionally includes an inner body 302. Inner body 302 has a retention tab 330 arranged on a second end 322 of inner body 302. Inner body 302 also has a groove 358 bounded by a first should 364 with a radial first height 366 and a second shoulder 370 with a radial second height 368. First height 366 is greater than second height 368. Because first height 366 is greater than second height 368, braze from a braze ring 360 (shown in FIG. 11) preferentially flows towards a braze target 356, which is arranged axially along outer surface 324 inner body 302, and which is arranged axially on a side of groove 358 opposite a braze stop 354. This causes brazed joint 352, and more particularly braze structure 372 (shown in FIG. 11), to be arranged on first end 320 of inner body 302.

It is to be understood and appreciated that, in the illustrated exemplary embodiment, braze ring 360 (shown in FIG. 9) is itself optional. In this respect, once inner body 302 is retained within outer body 304 by the retention tab 330 being received within retention groove 316 (shown in FIG. 8), a semi-liquid braze 301 can be introduced into fuel injector 300 circumferentially about an interface of inner body 302 and outer body 304, e.g., at a location axially offset from engagement joint 330. It is contemplated that semi-liquid braze 301 can be introduced with the aid of conduit, like a hypodermic needle (or hypodermic needle segment) 303, retention of inner body 302 within outer body 304 by seating of the retention tabs within the retention grooves as described above maintaining the spatial relationship of each to the other for formation of a second joint with a braze structure from semi-liquid braze 301. With application of a suitable amount of heat, semi-liquid braze 301 would flow to the right (relative to FIG. 11) toward groove 358, groove 358 serving as an optional braze stop.

Referring now to FIGS. 12-14, a fuel injector 400 according to a fourth embodiment is shown. Fuel injector 400 is similar to fuel injector 300 and additionally includes a welded joint 452. Welded joint 452 is on first end 420 of inner body 402 and is formed by application of weld energy to a weld target 466. Welded joint 452 can be formed subsequent to positioning inner body 402 relative outer body 404 and establishment of engagement joint 450 between second end 422 of inner body 402 and outer body 404. Welded joint 452 can include a weld structure 472, and can be a butt weld extending circumferentially about inner body 402 and outer body 404 by way of example.

Figure 15:
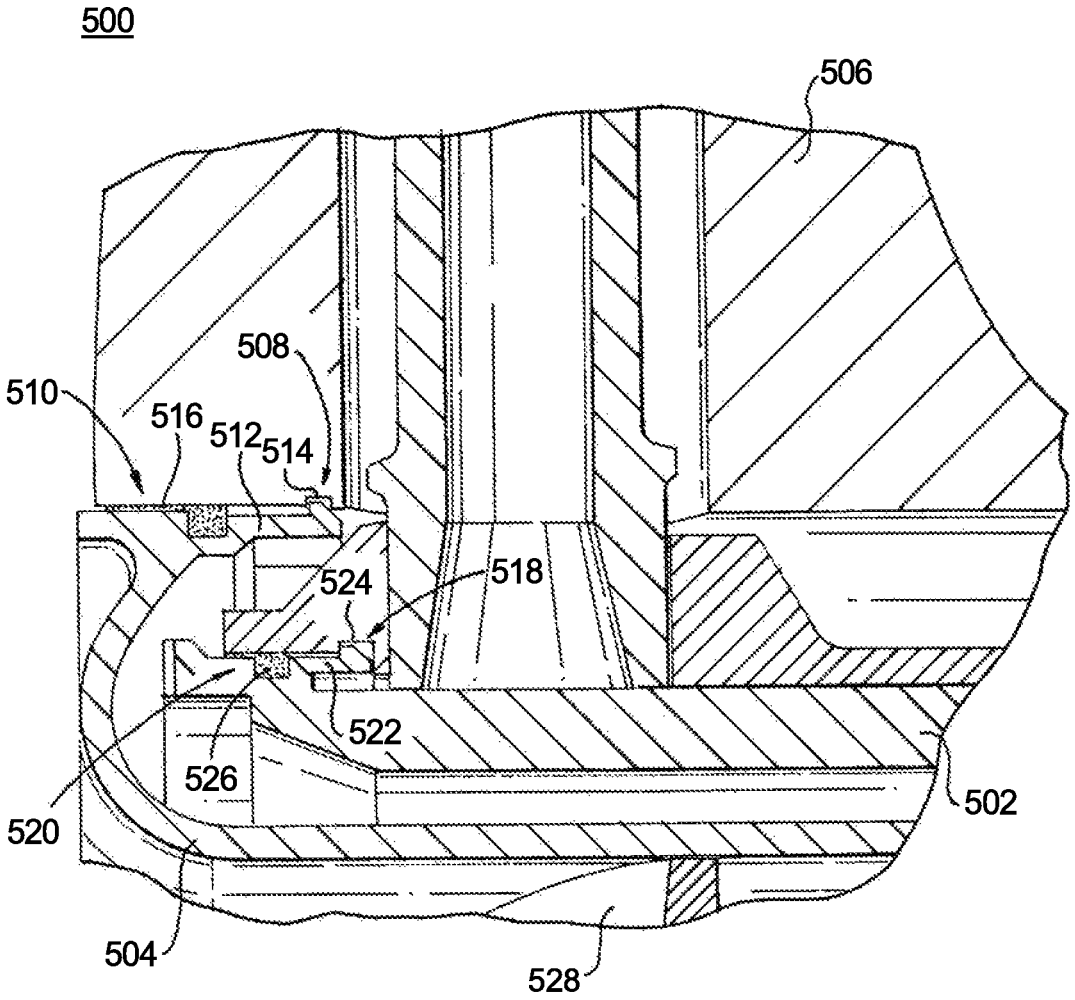
FIG. 15 is cross-sectional side view of a fuel injector, showing inner and intermediate bodies positioned within an outer body and retained therein by inner body and intermediate body retention tabs.

With reference to FIG. 15, a fuel injector 500 is shown. Fuel injector 500 is similar to fuel injector 100 (shown in FIG. 1) and additionally includes an intermediate body 502 arranged radially between an inner body 504 and an outer body 506. In the illustrated exemplary embodiment inner body 504 is a heat shield, intermediate body 502 is a prefilmer, and outer body 506 is an injector body. An air swirler 528 is arranged radially inward of intermediate body 502, intermediate body 502 (e.g., a heat shield) being arranged between outer body 506 and air swirler 528 for thermally insulating air swirler 528 from outer body 506. As will be appreciated by those of skill in the art, other arrangements of cylindrical fuel injector elements are possible, as suitable for an intended application.

Inner body 504 is positioned within outer body 506. In particular, inner body 504 is retained within outer body 506 by an inner body retention joint 508 and an inner body brazed joint 510. Inner body retention joint 508 includes a retention tab 512 received within a retention groove 514. Inner body brazed joint 510 includes a braze structure 516 that is axially offset from inner body first joint 508 and disposed radially between and inner body 504 and outer body 506.

Intermediate body 502 is positioned within outer body 506 and retained therein by an intermediate body retention joint 518 and an intermediate body brazed joint 520. Intermediate body retention joint 518 includes an intermediate body retention tab 522 received within a second outer boy retention groove 524. Intermediate body brazed joint 520 includes a braze structure 526 axially offset from intermediate body retention joint 518 and disposed radially between and intermediate body 502 and outer body 506.

Advantageously, in certain embodiments, inner body 504 and intermediate body 502 can both be spatially located within outer body 506 prior to brazing. This enables both inner body brazed joint 510 and intermediate body brazed joint 520 to be formed coincidently, e.g., in the same heating operation, simplifying manufacture of fuel injector 500. Further, more than one intermediate body 502 can be positioned within fuel injector 500 prior to intermediate body braze joint 520 being formed. As will be appreciated by those of skill in the art in view of the present disclosure, this prevents reheating a pre-existing braze structure, avoiding application thermal stress or softening the braze material, which could otherwise potentially disrupt the braze joint. As will also be appreciated by those of skill in the art in view of the present disclosure, welded joints can also be employed in lieu of brazed joints.

When joining parts using brazing or welding techniques, such as heat shields and prefilmers for gas turbine engine fuel injector assemblies, it can be necessary retain the positional arrangement of the parts until the joining process is complete. Retention is typically accomplished by a temporary retaining arrangement such as a tack weld, a ball-tack, weights, wire tie downs, and/or fixtures. Once the parts are joined the temporary retaining arrangement must be removed. In the case where a temporary tack weld or ball-tack is employed it can be necessary to rework the surfaces where welding was formed in order to restore finish and function in a further operation.

In embodiments described herein integral retention features are provided on the parts to be joined, e.g., an inner body and an outer body. The retention feature retains the parts in a selected spatial registration by forming a retention joint during the assembly of the parts. For example, the inner body can be registered relative to the outer body, inserted into an outer body, and positioned by pressing the inner body into the outer body such that a retention tab arranged on the inner body engages a retention groove within the outer body.

The seating of the retention tab within the retention groove establishes a retention joint between the inner body and the outer body, which retains the positional relationship between the inner body and outer body while a redundant brazed or welded joint is formed between the inner body and the outer body. Although described in the exemplary embodiments herein as being arranged on the inner body, those of skill in the art will appreciate in view of the present disclosure that the retention tab can be arranged on the outer body and a cooperative retention groove defined within the inner body.

In certain embodiments the integral retention feature, such as a tab, is arranged to snap into the groove when the inner body is pressed into to the outer body when the inner body reaches a desired position and orientation relative to the outer body. It is contemplated that the tab can be a locking tab located on a flexible portion of the part or component, e.g., on a resilient member, such that a slight deformation during assembly does not damage or limit the capability of the part or component once assembled. In accordance with certain embodiments, a braze ring or braze band can be seated on the inner body and captured within a braze ring groove defined within the outer surface of the inner body prior to assembly such that braze alloy forming the braze ring or braze band will be in the correct location to flow and create a brazed joint fixing the inner body within the outer body.

It is contemplated that the retention feature allow for quick and repeatable assembly of the inner and outer bodies prior to fixing the inner body within the outer body with a brazed or welded joint. Assembly can be accomplished by pressing the inner body into the outer body in a single operation prior to brazing or welding, such as with an arbor press, to establish a retention joint between the inner and outer bodies. As will be appreciated by those of skill in the art in view of the present disclosure, two or more inner bodies can be positioned within an outer body prior to the brazing or welding process. In accordance with certain embodiments, no additional operations are necessary to retain the parts or components in spatial registration to one another, eliminating the need for to retain the parts or components with a temporary weld, a temporary ball tack, a temporary tie, or use of a fixture prior to brazing or welding the inner body to the outer body to redundantly fix the inner body within the outer body with a brazed or welded joint. It is also contemplated that the need for gauging or measuring the positional relationship of the inner and outer bodies can be eliminated as the inner and outer bodies can themselves report correct spatial registration by issuing an audible signal, e.g., a 'click', once the inner body reaches a selected position within the outer body.

The methods and systems of the present disclosure, as described above and shown in the drawings, provide for fuel injector assemblies and methods of making fuel injector assemblies with superior properties including redundant joints and simplified assembly. While the apparatus and methods of the subject disclosure have been shown and described with reference to preferred embodiments, those skilled in the art will readily appreciate that change and/or modifications may be made thereto without departing from the scope of the subject disclosure.

What is claimed is:

1. A fuel injector, comprising:

an outer body extending about an axis with a radially inner surface, wherein the radially inner surface defines a retention groove in the inner surface of the outer body, wherein the retention groove includes a floor and two opposed side walls extending from the floor;

an inner body positioned within the outer body and having an outer surface and a retention tab, the inner body being axially retained relative to the outer body by engagement of the retention tab within the retention groove axially between the sidewalls; and a joint axially offset from the retention tab and fixing the inner body to the outer body, wherein the joint is located radially between the inner body and the outer body.

2. The fuel injector as recited in claim 1, wherein the retention tab includes a resilient member with a barb extending from the resilient member.

3. The fuel injector as recited in claim 1, wherein the inner body defines an axial slot bounding the resilient member.

4. The fuel injector as recited in claim 1, wherein the joint includes a braze structure disposed between the outer surface of the inner body and the inner surface of the outer body.

5. The fuel injector as recited in claim 4, wherein the inner body defines a groove in the outer surface of the inner body, the braze structure at least partially overlapping the groove.

6. The fuel injector as recited in claim 5, wherein the groove is bounded by a first shoulder and a second shoulder, the first shoulder having height greater than height of the second shoulder.

7. The fuel injector as recited in claim 5, wherein braze ring groove is bounded a first shoulder and a second shoulder, the first shoulder having height that is about the same as height of the second shoulder.

8. The fuel injector as recited in claim 4, wherein the inner body has a braze target on the outer surface of the inner body, wherein the braze target is axially offset from the retention tab, and wherein the braze structure overlaps the braze target.

9. The fuel injector as recited in claim 4, wherein the inner body has a braze stop in the outer surface of the inner body, wherein the braze stop is arranged axially between the retention tab and a braze target.

10. The fuel injector as recited in claim 1, wherein the joint includes a weld structure disposed between the interior surface of the outer body and the outer surface of the inner body.

11. The fuel injector as recited in claim 1, wherein the outer body has a first end, an opposite second end, and a ramp arranged on the first end of the outer body.

12. The fuel injector as recited in claim 11, wherein the inner body is retained within the outer body between the ramp and the second end of the outer body.

13. The fuel injector as recited in claim 1, wherein the inner body includes a heat shield, wherein the heat shield is arranged radially between the outer body and an air swirler.

14. The fuel injector as recited in claim 1, wherein the outer body includes at least one of a heat shield, a swirler, and a prefilmer.

15. The fuel injector as recited in claim 1, wherein the retention groove is a first retention groove, the joint is an inner body brazed joint, and the fuel injector having a second retention groove and further comprising:

an intermediate body positioned within the outer body having an outer surface and an intermediate body retention tab, wherein the intermediate body retention tab is received with the second retention groove; and an intermediate body brazed joint offset from the intermediate retention tab and disposed between the outer surface of the intermediate body and the inner surface of the fuel injector, wherein the intermediate body brazed joint is axially spaced apart from the intermediate body retention tab along the intermediate body.

16. A fuel injector, comprising:

an outer body extending about an axis with a radially inner surface, wherein the radially inner surface defines a retention groove in the inner surface of the outer body, wherein the retention groove includes a floor and two opposed side walls extending from the floor;

a heat shield retained within the outer body having an outer surface and a retention tab, wherein the retention tab is received in the retention groove axially between the sidewalls; and a joint offset from the retention tab fixing the heat shield to the outer body, wherein the joint is axially spaced apart from the retention tab along the heat shield, wherein the joint includes a braze structure disposed between the outer surface of the heat shield and the inner surface of the outer body.

17. A fuel injector, comprising:

an outer body extending about an axis with a radially inner surface, wherein the radially inner surface defines a retention groove in the inner surface of the outer body;

an inner body positioned within the outer body and having an outer surface and a retention tab, the inner body being axially retained relative to the outer body by engagement of the retention tab within the retention groove; and a joint axially offset from the retention tab and fixing the inner body to the outer body, wherein the joint is located radially between the inner body and the outer body, wherein the joint includes a braze structure disposed between the outer surface of the inner body and the inner surface of the outer body, wherein the inner body defines a groove in the outer surface of the inner body, the braze structure at least partially overlapping the groove, wherein the groove is bounded by a first shoulder and a second shoulder, the first shoulder having height greater than height of the second shoulder.

18. A fuel injector, comprising:

an outer body extending about an axis with a radially inner surface, wherein the radially inner surface defines a retention groove in the inner surface of the outer body;

an inner body positioned within the outer body and having an outer surface and a retention tab, the inner body being axially retained relative to the outer body by engagement of the retention tab within the retention groove; and a joint axially offset from the retention tab and fixing the inner body to the outer body, wherein the joint is located radially between the inner body and the outer body, wherein the retention groove is a first retention groove, the joint is an inner body brazed joint, and the fuel injector having a second retention groove and further comprising:

an intermediate body positioned within the outer body having an outer surface and an intermediate body retention tab, wherein the intermediate body retention tab is received with the second retention groove; and an intermediate body brazed joint offset from the intermediate retention tab and disposed between the outer surface of the intermediate body and the inner surface of the fuel injector, wherein the intermediate body brazed joint is axially spaced apart from the intermediate body retention tab along the intermediate body.

* * * * *